US007115077B2

(12) United States Patent
Yang

(10) Patent No.: US 7,115,077 B2
(45) Date of Patent: Oct. 3, 2006

(54) EXERCISE ROWING MACHINE

(76) Inventor: Lien-Chuan Yang, 11F-1, No. 149, Sec. 3, Roosevelt Rd., Taipei (TW)

( * ) Notice: Subject to any disclaimer, the term of this patent is extended or adjusted under 35 U.S.C. 154(b) by 80 days.

(21) Appl. No.: 11/053,414

(22) Filed: Feb. 9, 2005

(65) Prior Publication Data

US 2006/0189455 A1 Aug. 24, 2006

(51) Int. Cl.
*A63B 69/06* (2006.01)
*A63B 21/008* (2006.01)

(52) U.S. Cl. ..... 482/73; 482/112; 482/137

(58) Field of Classification Search ..... 482/51, 482/72, 73, 95, 96, 111–113, 137
See application file for complete search history.

(56) References Cited

U.S. PATENT DOCUMENTS 5,441,469 A * 8/1995 Chern ..... 482/72
5,512,027 A * 4/1996 Chen ..... 482/72
5,547,444 A * 8/1996 Huang ..... 482/72
5,569,130 A * 10/1996 Wang et al. ..... 482/96
5,575,741 A * 11/1996 Fan ..... 482/72
7,022,052 B1 * 4/2006 Lai ..... 482/72

* cited by examiner

*Primary Examiner*—Jerome Donnelly
*Assistant Examiner*—Victor K. Hwang
(74) *Attorney, Agent, or Firm*—Lowe Hauptman & Berner, LLP

(57) ABSTRACT

An exercise rowing machine of which a main shank has thereon a seat slidable relatively thereto, the shank has on its front end two lateral pedals, and has on its front and rear ends respectively two supporting racks, and has therebeneath at its central area a connecting seat pivotally connected with one end of an adapter of which the other end is connected with a buffer, so that the adapter can be waved to and fro by a force. The adapter connects a transverse rod of which two ends respectively pivotally connect two operating rods that each has an upper and a lower section bending inwards one relative to the other for an obtuse angle; the operating rods are provided symmetrically at the two lateral sides of the shank, thereby when the machine is rowed forwards and rearwards, touching of the body of a user can be avoided; and when the machine is folded and collapsed about the shank which is being as a middle line, storing and transporting spaces can be effectively reduced. The machine is applicable to use for indoor exercising.

6 Claims, 7 Drawing Sheets

EXERCISE ROWING MACHINE

BACKGROUND OF THE INVENTION

1. Field of the Invention

The present invention relates to an exercise rowing machine; and particularly to an exercise rowing machine having at lateral sides of its main shank two lateral operating rods each with an upper section bent inwards relative to a lower section in an obtuse angle; when the machine is rowed forwards and rearwards, touching of the body of a user can be avoided; and when the machine is folded and collapsed, the spaces for storing and for transporting can be effectively reduced. The machine is applicable to use for indoor exercising.

2. Description of the Prior Art

For body shaping and obtaining an effect of being healthy through exercising, manufacturers nowadays have developed various exercising instruments for choices of users. Among multiple sets of body shaping equipment, exercise rowing machines had been used in a large amount decades ago; they are used to strengthen muscles of hands, legs, chests, waists and backs through actions simulating rowing boats, and are all-part exercise equipment.

FIG. 6 depicts a conventional exercise rowing machine which includes a main shank "a" and a supporting rack a1, the main shank "a" is provided thereon with a seat a2, the supporting rack a1 is pivotally connected with two oil pressure cylinders a3 and two handles a4 at its two lateral sides, each handle a4 is linked up with an oil pressure cylinder a3, the supporting rack a1 is provided on its front end with two peddles a5. When a user seats on the seat a2 with his two feet stepping on the two pedals a5 respectively, he can pull the two handles a4 with his hands against the impedance force provided by the oil pressure cylinders a3; when the handles a4 are pulled rearwards for a distance, they can be moved forwards back to their original positions by the restoring forces of the oil pressure cylinders a3, this provides the user to and fro actions simulating rowing boats.

The above stated exercise rowing machine can effectively achieve a function of exercising for body shaping, however, its supporting rack a1 is overly wide, and the handles a4 are not foldable, the entire volume of its structure is quite bulky and is inconvenient for storage and transporting.

As shown in FIGS. 7 and 8 depicting a foldable exercise rowing machine that mainly uses pivot structures to make handles "b" and arms b1 mutually rotatable, when in folding and collapsing, the arms b1 and the handles "b" can be rotated to be clung to a main shank b2, this can effectively reduce the space for storing. However, such a pivot structure for the exercise rowing machine includes a plurality of pivot connecting elements, although is convenient in folding and collapsing, its amount of the members to be assembled is also increased, and therefore it will render the possibility of damaging while in use.

In view of this, and in order to get rid of the defects stated above to render an exercise rowing machine able to save members, convenient for folding and collapsing as well as to effectively reduce the space for storing, the inventor provides the present invention based on his professional experience of years in studying and improvement.

SUMMARY OF THE INVENTION

The main objective of the present invention is to provide an exercise rowing machine, by having at lateral sides of its main shank symmetrically two lateral operating rods each with an upper section bent relative to a lower section, a user can smoothly row forwards and rearwards within a minimum space of activity, and the space for storing can be reduced after the machine being folded and collapsed; thus elements required can be reduced to the minimum, the structure of the machine can be improved.

Therefore, in order to achieve the above stated objective, the exercise rowing machine of the present invention is comprised of a main shank, a front and a rear supporting rack, a rotatable assembly and two operating rods. The main shank is provided thereon with a seat slidable relatively to the main shank, and is provided therebeneath with a connecting seat at the central area of the main shank; the main shank is provided on its front end with two lateral pedals, and is provided on its front and rear ends respectively with the two supporting racks to bear the weights of the main shank and a user on them. The rotatable assembly includes an adapter in connecting with a transverse rod; one end of the adapter is pivotally connected with the connecting seat, the other end is connected with a buffer, so that the adapter can be waved to and fro by a force. The two operating rods are bending rods to have an upper and a lower section each, the lower section is a connecting portion, the upper section is a handle portion; the two connecting portions are respectively pivotally connected to the two ends of the transverse rod, each connecting portion intersects a handle portion by an obtuse angle; the handle portions are bent inwards and are provided symmetrically at the two lateral sides of the main shank, thereby when the machine is rowed forwards and rearwards, touching of the body of a user can be avoided.

Therefore, the present invention not only has its members reduced and is convenient for operating, but also is able to reduce space of storing and transporting after the two operating rods are folded and collapsed about the main shank which is being as a middle line.

The present invention will be apparent after reading the detailed description of the preferred embodiment thereof in reference to the accompanying drawings.

DETAILED DESCRIPTION OF THE PREFERRED EMBODIMENT

Figure 1:
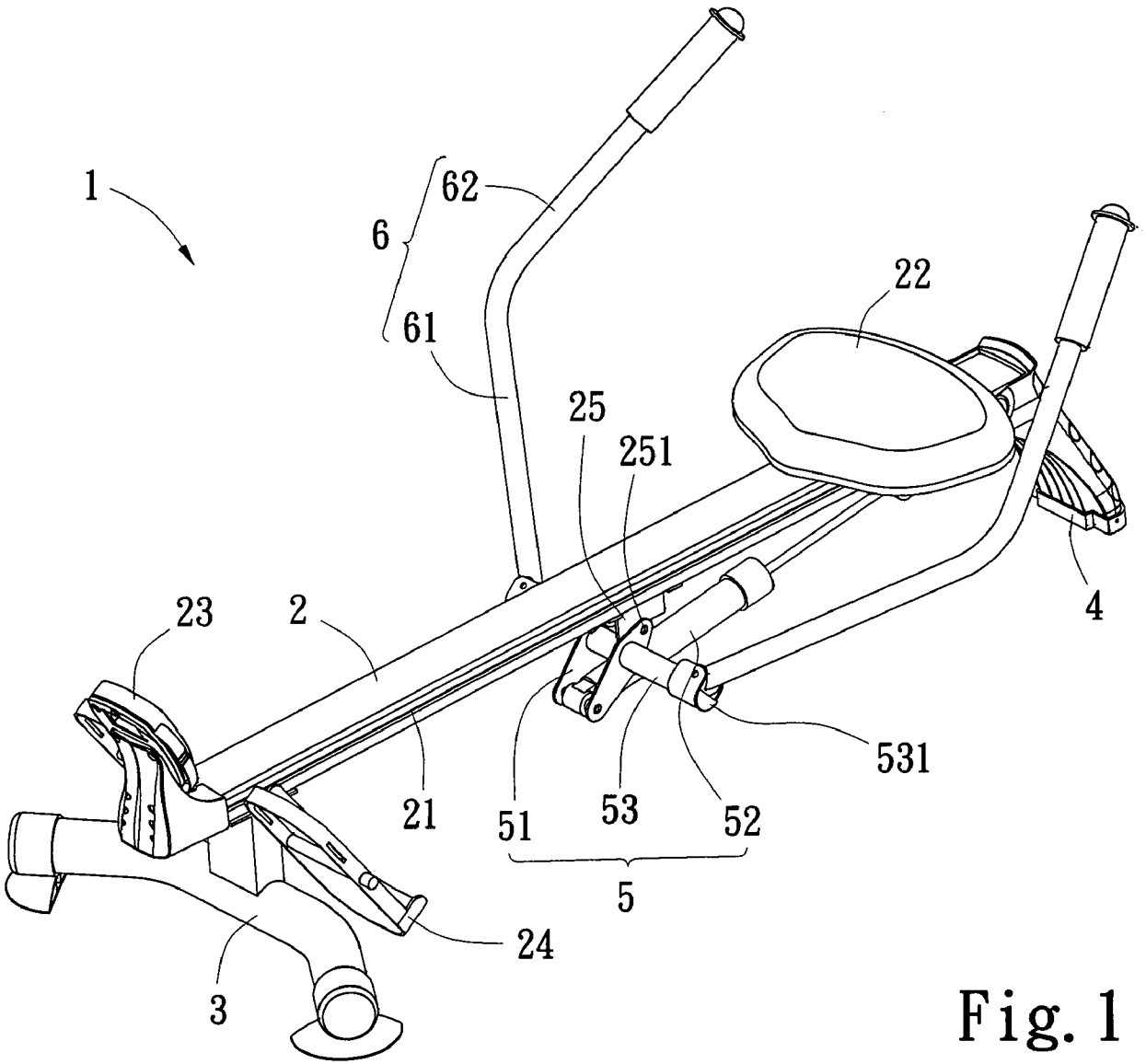
FIG. 1 is a perspective view of an embodiment of the exercise rowing machine of the present invention.
Figure 2:
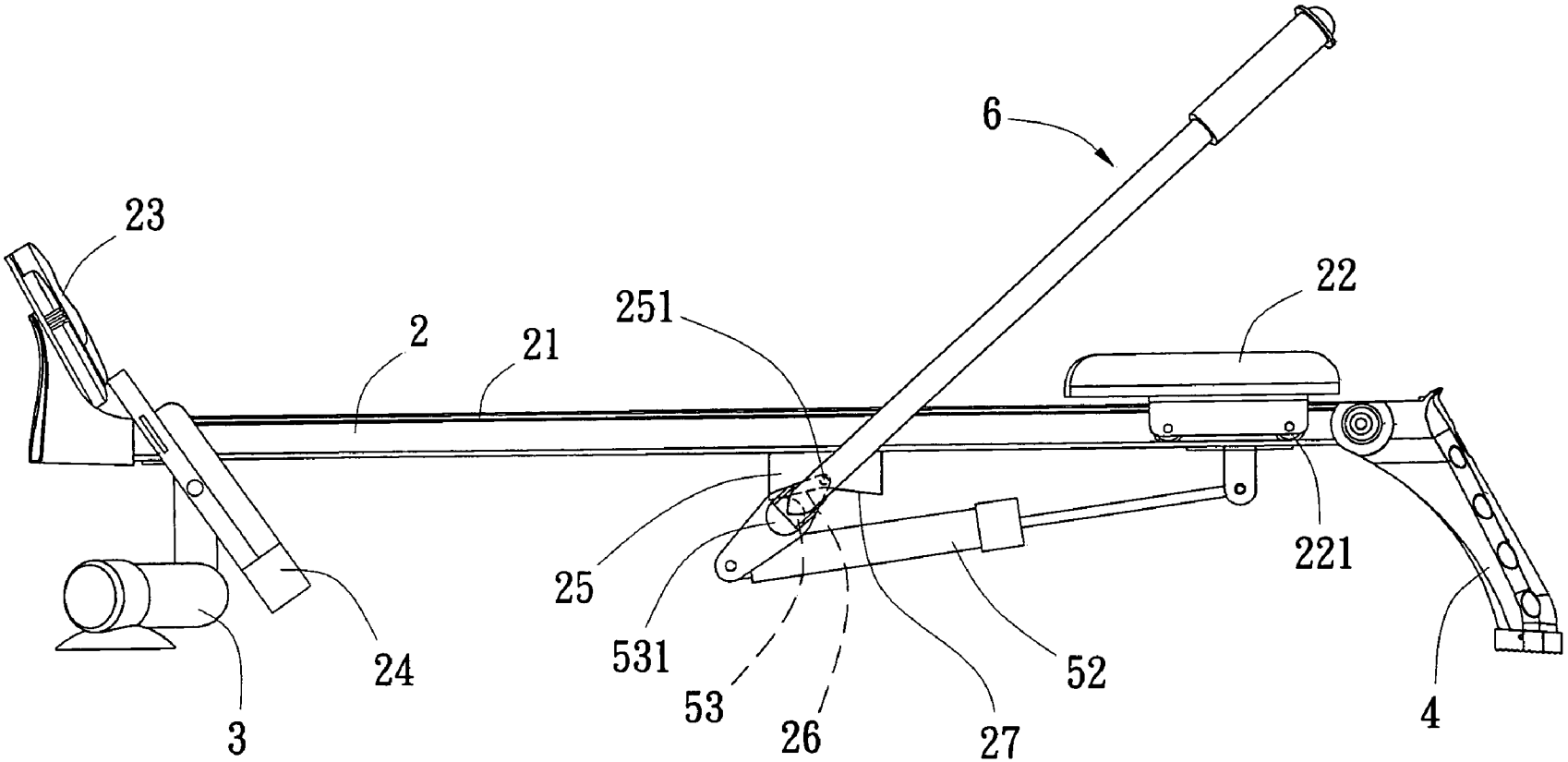
FIG. 2 is a side view taken from FIG. 1.

Referring firstly to FIGS. 1, 2 showing a preferred embodiment of the exercise rowing machine 1 of the present invention, the machine is comprised of a main shank 2, a front and a rear supporting rack 3, 4, a rotatable assembly 5 and two operating rods 6.

The main shank 2 is an elongate bar with two lateral rails 21, it is provided thereon with a seat 22 and is provided therebeneath with wheels 221 for sliding (by rolling) on the two lateral rails 21 of the main shank 2, so that the seat 22 can slide relatively to the main shank 2. The main shank 2 is connected beneath its front and rear ends with the front and the rear supporting racks 3, 4 respectively; the rear supporting rack 4 pivotally is connected to the rear end of the main shank 2, the front and the rear supporting racks 3, 4 bear the weights of the main shank 2 and a user on them. The main shank 2 is connected on its front end with a display 23 and two lateral pedals 24. The main shank 2 is provided therebeneath its central area with a connecting seat 25 which is provided with a pivot portion 251 transversely extending therethrough; the connecting seat 25 forms on its bottom two mutually connecting bottom surfaces 26, 27 functioning as a front and a rear limit portion.

The rotatable assembly 5 includes an adapter 51, a buffer 52 and a transverse rod 53, the adapter 51 is composed of two plain plates; one end of the adapter 51 is pivotally connected to the pivot portion 251 of the connecting seat 25, in order that the adapter 51 can be waved to and fro by a force. The two ends of the buffer 52 are respectively connected with the other end of the adapter 51 and the area beneath the rear end of the main shank 2. The transverse rod 53 is extended through and connected to the adapter 51, the two ends of the transverse rod 53 are provided respectively with two stop portions 531 to limit the overturning angle of the operating rods 6.

The two operating rods 6 are symmetrically provided at the two lateral sides of the main shank 2, and they are bending rods to have an upper and a lower section each, the lower section is a connecting portion 61, the upper section is a handle portion 62; the two connecting portions 61 each intersects one of the handle portions 62 by an obtuse angle, and are respectively pivotally connected to the two ends of the transverse rod 53; the two operating rods 6 can be folded inwards and collapsed about the main shank for which being as a middle line.

Figure 3:
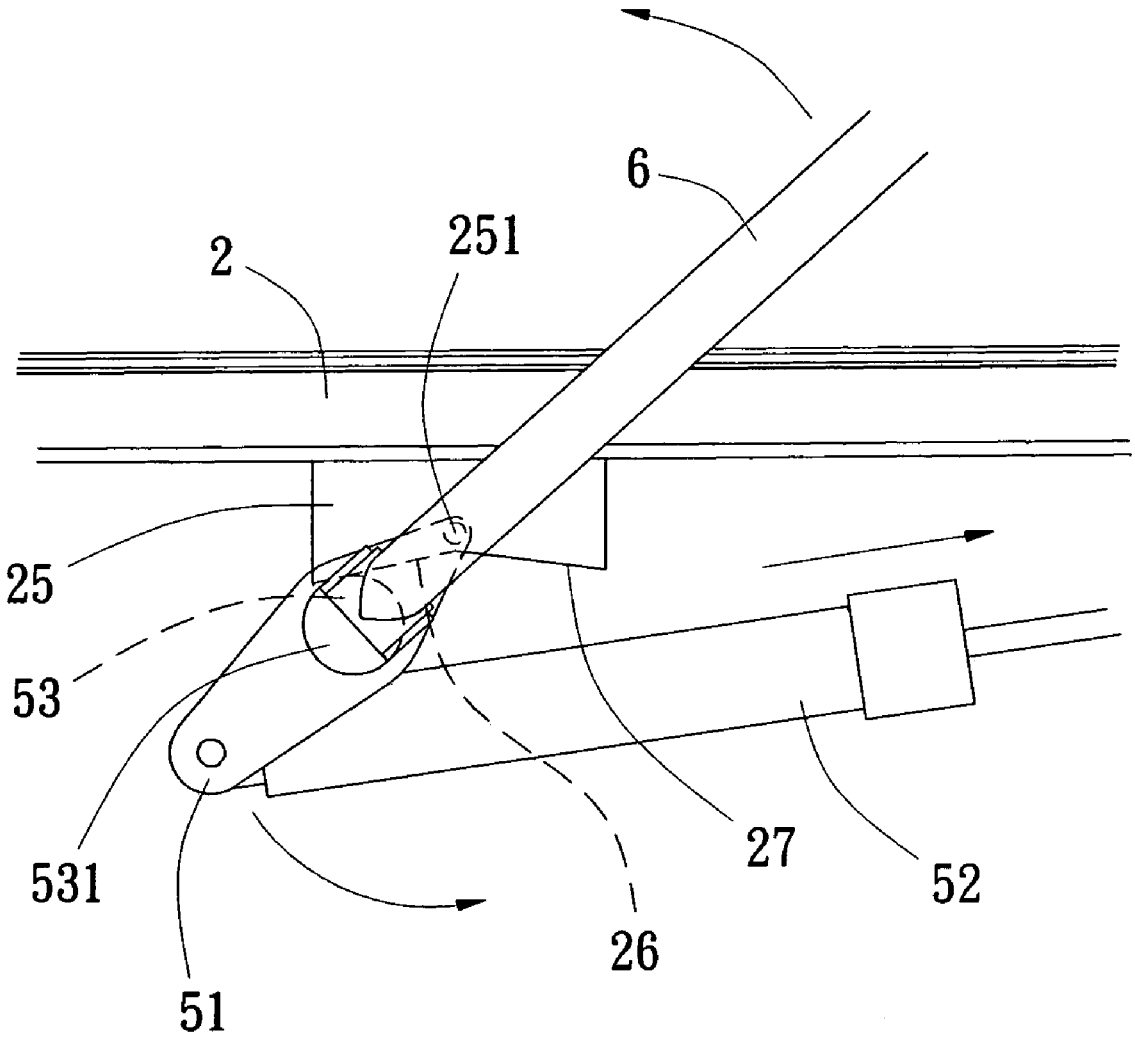
FIG. 3 is a partial enlarged side view taken from FIG. 2.
Figure 4:
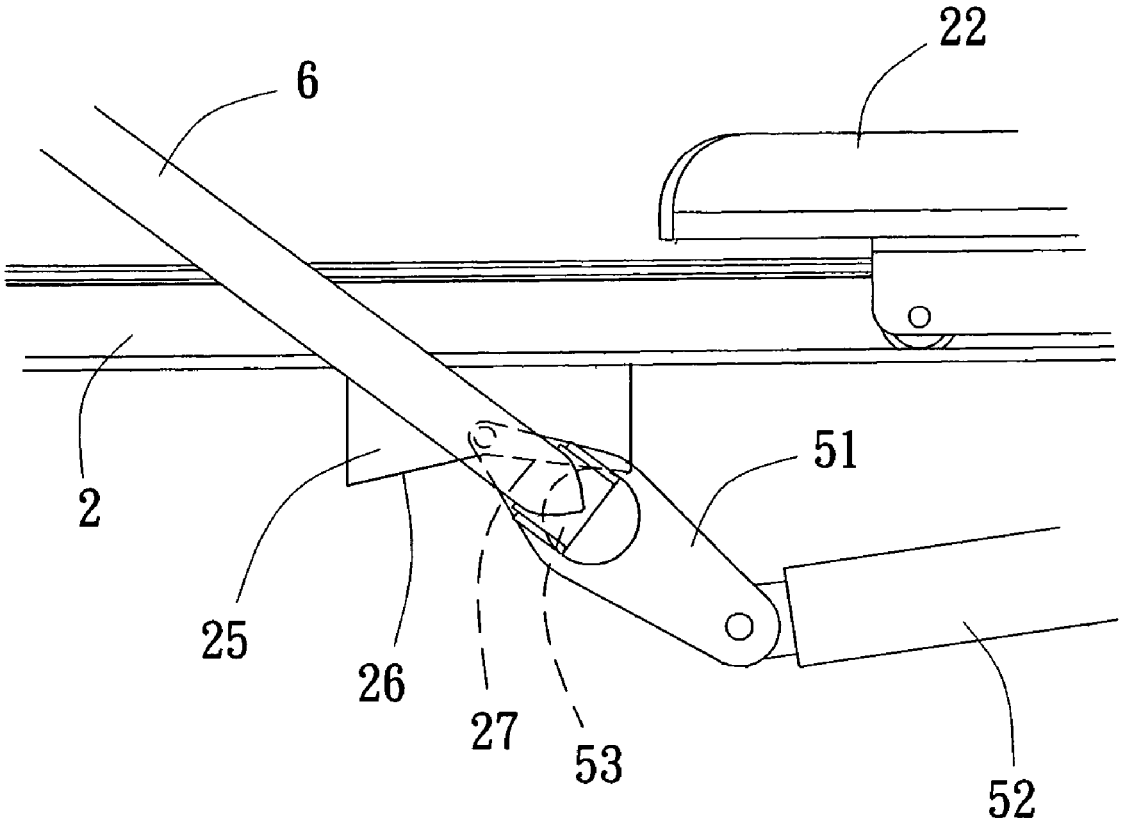
FIG. 4 is a schematic view showing rotating forwards of an operating rod of the present invention in use.

Referring to FIGS. 2–4, when the present invention is in operation, a user seats on the seat 22 of the main shank 2 with his feet stepping on the two pedals 24; and when the two hands of the user hold the operating rods 6 and pull rearwards, the transverse rod 53 and the adapter 51 are moved to rotate rearwards about the pivot portion 251 of the connecting seat 25, meantime, the buffer 52 is compressed.

When the two operating rods 6 are pulled rearwards to a predetermined angle, the transverse rod 53 abuts against the bottom surface 26 below the connecting seat 25 to render the two operating rods 6 unable to be further pulled (as shown in FIG. 3). At this time, the hands of the user respectively push outwards, and the buffer 52 generates a rebounding force to force the two operating rods 6 to rotate forwards. During the process of rotation, by the design of the bent operating rods 6, touching of the body of the user can be avoided. When the transverse rod 53 abuts against the bottom surface 27 below the connecting seat 25, the two operating rods 6 are unable to keep on rotating (as shown in FIG. 4). Hence by operating to and fro of the user, an effect of exercising simulating boat rowing for body shaping can be obtained.

Figure 5:
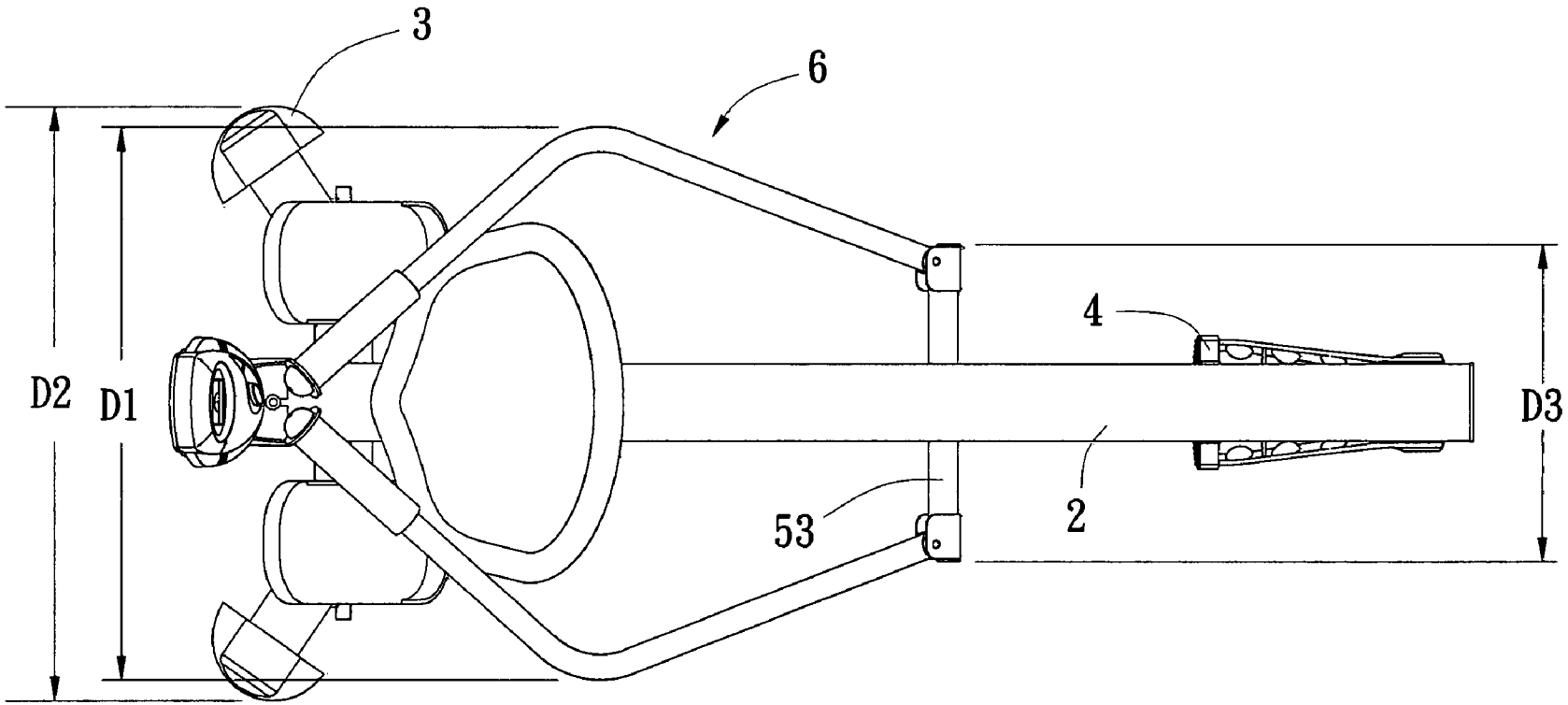
FIG. 5 is a schematic view showing folding and collapsing of the operating rod of the present invention in use.
Figure 6:
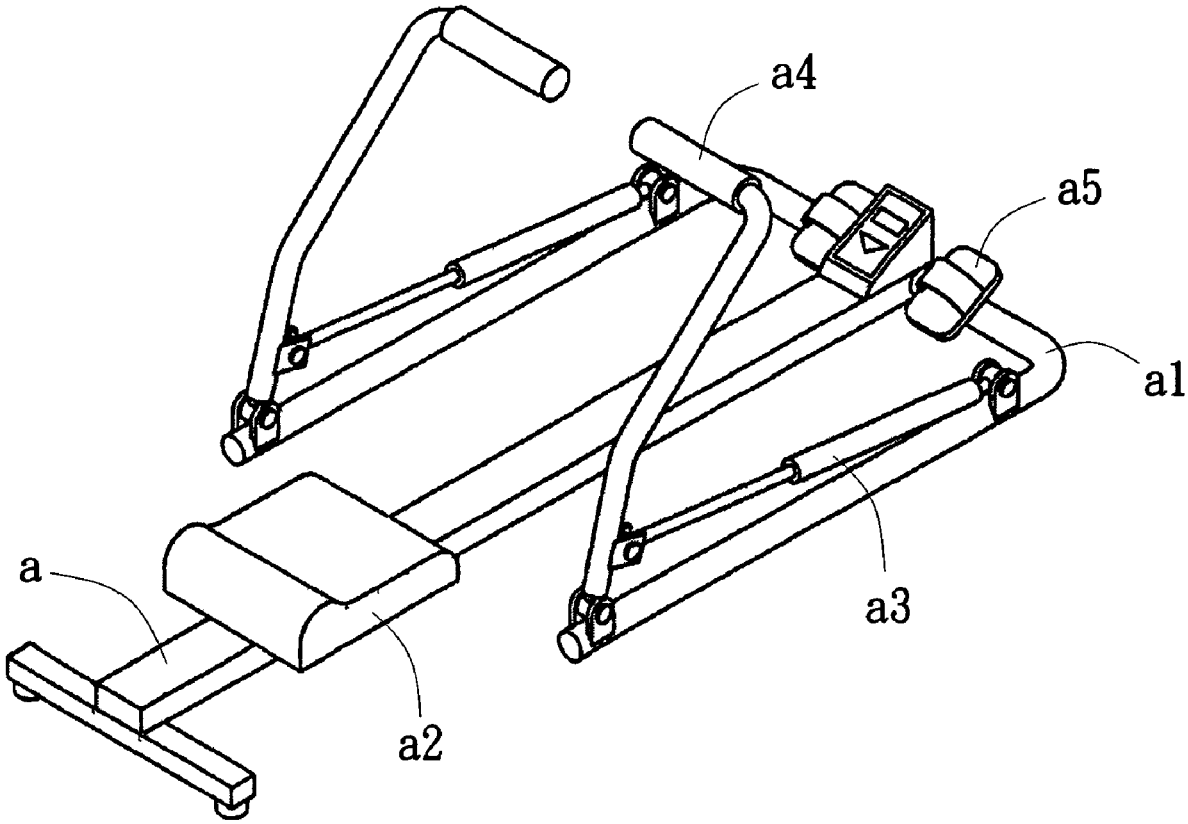
Fig. 6 (Prior Art)
FIG. 6 is a perspective view showing the appearance of a conventional exercise rowing machine.
Figure 7:
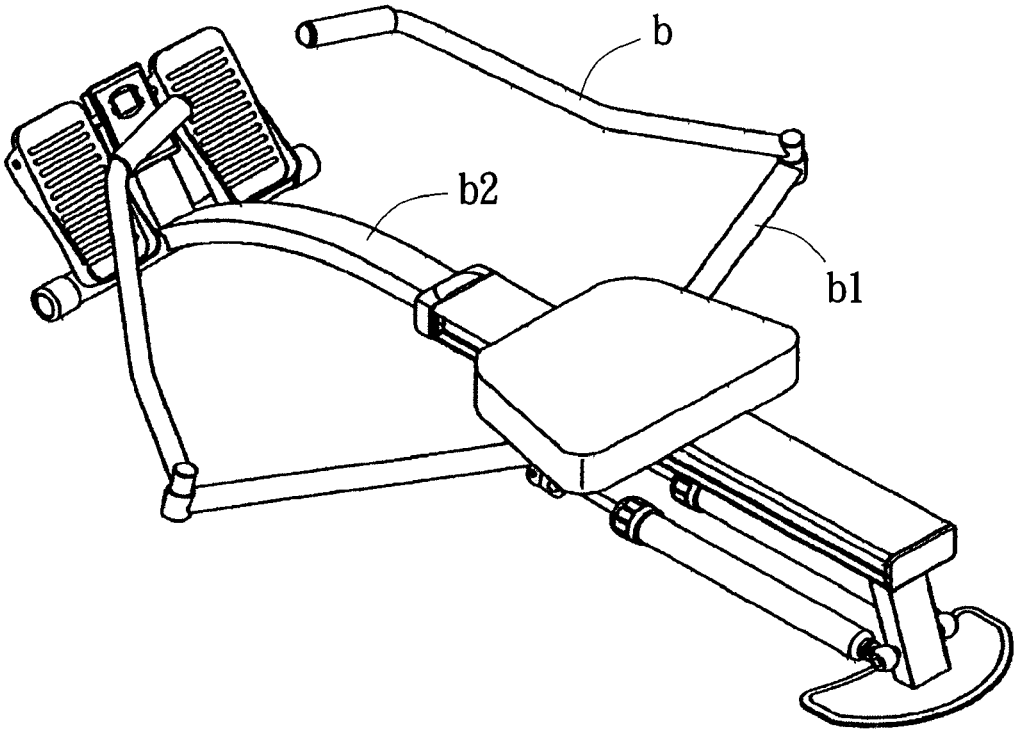
Fig. 7 (Prior Art)
FIG. 7 is a perspective view showing the appearance of another conventional exercise rowing machine.
Figure 8:
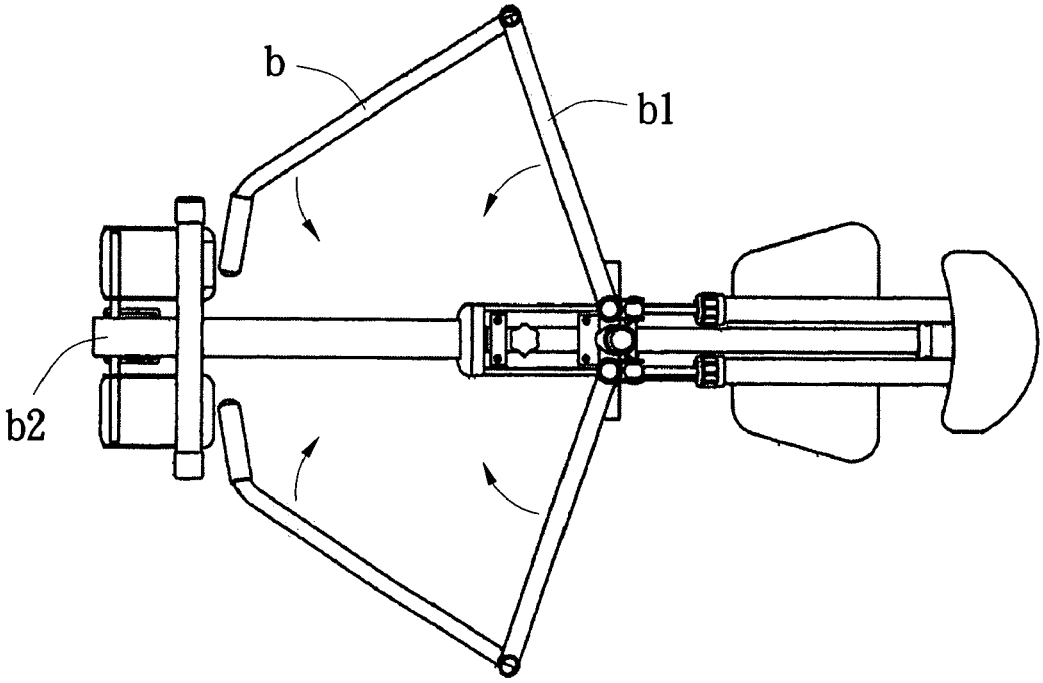
Fig. 8 (Prior Art)
FIG. 8 is a schematic view showing folding and collapsing of handles and arms of FIG. 7 in use.

Referring to FIG. 5 showing the folding and collapsing of the present invention, wherein the rear supporting rack 4 can be rotated to be collapsed at the rear end of the main shank 2, while each of the two operating rods 6 bending inwards has a gross width D1 shorter than the width D2 of any of the front and the rear supporting racks 3, 4, and the length D3 of the transverse rod 53 is also shorter than the width D2 of any of the front and the rear supporting racks 3, 4; thereby, an objective of reducing storing space after folding and collapsing the structure can be achieved.

The present invention thereby has the following advantages:

1. By the design of the two operating rods bending each for an obtuse angle, a user can smoothly row forwards and rearwards, and the space for storing can be reduced after the machine being folded and collapsed; thus waste of storage space can be avoided.
2. When in using the present invention, the two operating rods are positioned at different forward and rearward tilting angles respectively; the user can get and keep a best operating angle to obtain a most effective effect of body shaping.
3. The two ends of the transverse rod are provided respectively with two stop portions to limit the overturning angle of the operating rods, thereby when the hands of the user release the operating rods, the operating rods will not impact the ground. And the operating rods are convenient for the user to reuse and hold again.
4. The improvement of the structure of the present invention not only largely reduces the elements and is convenient for assembling, but also reduces the possibility of damaging while in use.

According to the above disclosed, the present invention can surely achieve the expected objective to provide an exercise rowing machine which can save elements, is convenient for folding and collapsing and effectively reduces storing space.

The invention claimed is:

1. An exercise rowing machine comprising:

a main shank provided thereon with a seat for sliding relatively to said main shank, said main shank is provided therebeneath and at its central area with a connecting seat, and is connected on its front end with two lateral pedals;

a front and a rear supporting rack to bear a front end and a rear end of said main shank;

a rotatable assembly including an adapter, one end of said adapter is pivotally connected to said connecting seat, the other end of said adapter is connected with a buffer, in order that said adapter is waved to and fro by a force, said adapter is further connected with a transverse rod; and two operating rods which are bending rods to have an upper and a lower section each, said lower section is a connecting portion, said upper section is a handle portion; said two connecting portions are respectively pivotally connected to two ends of said transverse rod, and each intersects one of said handle portions by an obtuse angle; said handle portions are folded inwards and collapsed and provided symmetrically at two lateral sides of said main shank, so that when in rowing forwards and rearwards of said operating rods, touching of the body of a user is avoided, and width of said machine is reduced when it is folded and collapsed forwards.

2. The exercise rowing machine as in claim 1, wherein length of said transverse rod is shorter than width of any of said front and rear supporting racks.

3. The exercise rowing machine as in claim 1, wherein said connecting seat has on its bottom a front and a rear limit portion to respectively position said transverse rod when said adapter is waved to and fro by a force.

4. The exercise rowing machine as in claim 1, wherein said two ends of said transverse rod are provided respec tively with two stop portions to limit overturning angles of said operating rods.

5. The exercise rowing machine as in claim 1, wherein said rear supporting rack is provided pivotally on a rear end of said main shank and is for folding and collapsing.

6. The exercise rowing machine as in claim 1, wherein said buffer is connected on its one end to an area beneath a rear end of said main shank.

* * * * *